United States Patent [19]

Cooper

[11] 4,412,601

[45] Nov. 1, 1983

[54] ELEVATOR STORAGE SYSTEM

[76] Inventor: Gary D. Cooper, 3720 Danbury Dr., Arlington, Tex. 76016

[21] Appl. No.: 255,211

[22] Filed: Apr. 17, 1981

[51] Int. Cl.[3] ..... B66B 11/04

[52] U.S. Cl. ..... 187/27; 312/247

[58] Field of Search ..... 187/20, 27, 1 R, 3-5, 187/95; 211/113, 1.5, 86, 87, 209, 207, 175; 248/320, 327, 328, 329, 323, 317, 330.1; 312/246, 247, 306, 294, 312; 308/30, 3 R, 1 R; 49/463-466, 147; 52/461, 64, 177, 182; 182/142; 220/353; 254/387; 92/51-53, 165; 212/269; 403/13

[56] References Cited

U.S. PATENT DOCUMENTS

| | | | |
|---|---|---|---|
| 265,012 | 9/1882 | Bobzien | 187/27 |
| 364,863 | 6/1887 | Schollian et al. | 187/27 |
| 982,056 | 1/1911 | Hammell | 187/3 |
| 1,305,492 | 6/1919 | Quass | 52/461 |
| 1,379,487 | 5/1921 | Swanson | 49/463 |
| 1,913,066 | 6/1933 | Carter | 52/461 |
| 2,014,035 | 9/1935 | Attwood | 52/461 |
| 2,463,537 | 3/1949 | Hoar et al. | 92/165 R |
| 2,499,791 | 3/1950 | Spencer | 312/247 |
| 2,869,908 | 1/1959 | Ford | 248/320 |

*Primary Examiner*—Kenneth W. Noland
*Attorney, Agent, or Firm*—Peter J. Murphy

[57] ABSTRACT

An elevator storage unit, supporting or containing the articles to be stored, is normally disposed in an above-ceiling enclosure defined by a ceiling opening and overlying enclosure structure. The base platform for the elevator unit defines the closure for the above-ceiling enclosure, in the upper limit position of the unit. The elevator unit is lowered and raised by means of an electric motor powered hoist mechanism, under control of a keyed switch. The elevator unit is lowered for access, and is raised to the above-ceiling position for convenient storage and/or security storage. The elevator unit includes an upper support member from which the base platform is suspended by cables. The support member is suspended by hoist mechanism cables. The elevator unit may function as utility unit for supporting a TV set or a beverage bar in a use condition suspended from the ceiling, but normally stored within the above-ceiling compartment. Corner guides associated with the base platform assure smooth seating within the ceiling opening. The enclosure is readily assembled from prefabricated panels and associated components, and is readily mounted within a ceiling opening.

13 Claims, 12 Drawing Figures

ELEVATOR STORAGE SYSTEM

This invention relates to a system including an above ceiling storage space and an elevator unit disposed in that space to be lowered for use to utilize above-ceiling space for convenient storage.

Due to the high construction costs of residences and other buildings, it is desirable to make use of all of the space within the building enclosure. To provide closet or storage space by enlarging the floor plan is very expensive, particularly if otherwise unused space may be utilized to provide accessible and otherwise convenient closet or storage space.

A principal object of this invention is to provide novel means for utilizing attic or other above-ceiling space as a convenient and accessible storage or closet space for clothes or other articles.

Another object of this invention is to provide storage space functioning as security storage for valuable articles or other items.

A further object of this invention is to provide a novel utility unit stored in above-ceiling space and adapted to be lowered to the use position.

Still another object of this invention is to provide a novel above-ceiling storage system including a readily assembled storage enclosure for mounting in association with a ceiling opening.

These objects are accomplished in a storage system for use in association with a ceiling structure, which system includes a storage chamber defined by a ceiling entry opening and overlying above-ceiling space. An elevator unit, normally disposed within that chamber, includes an upper transverse support member, a base platform defining a closure for the ceiling opening, and hanger members suspending from the support member for supporting the base platform. An elevator mechanism includes hoist means supported within the storage chamber and at least one lift cable associated with the hoist means and having its lower end connected to the support member, and means for activating the hoist means to lower and raise the elevator unit. More particularly, corner guides are mounted on peripherally spaced corners of the platform, providing camming surfaces coacting with the ceiling opening to guide the base platform and closure member smoothly into the ceiling opening. Still more particularly, a readily assembled closure structure provides the storage chamber.

The novel features and the advantages of the invention, as well as additional objects thereof, will be more fully understood from the following description when read in connection with the accompanying drawings.

DRAWINGS

DESCRIPTION OF THE PREFERRED EMBODIMENTS

Figure 1:
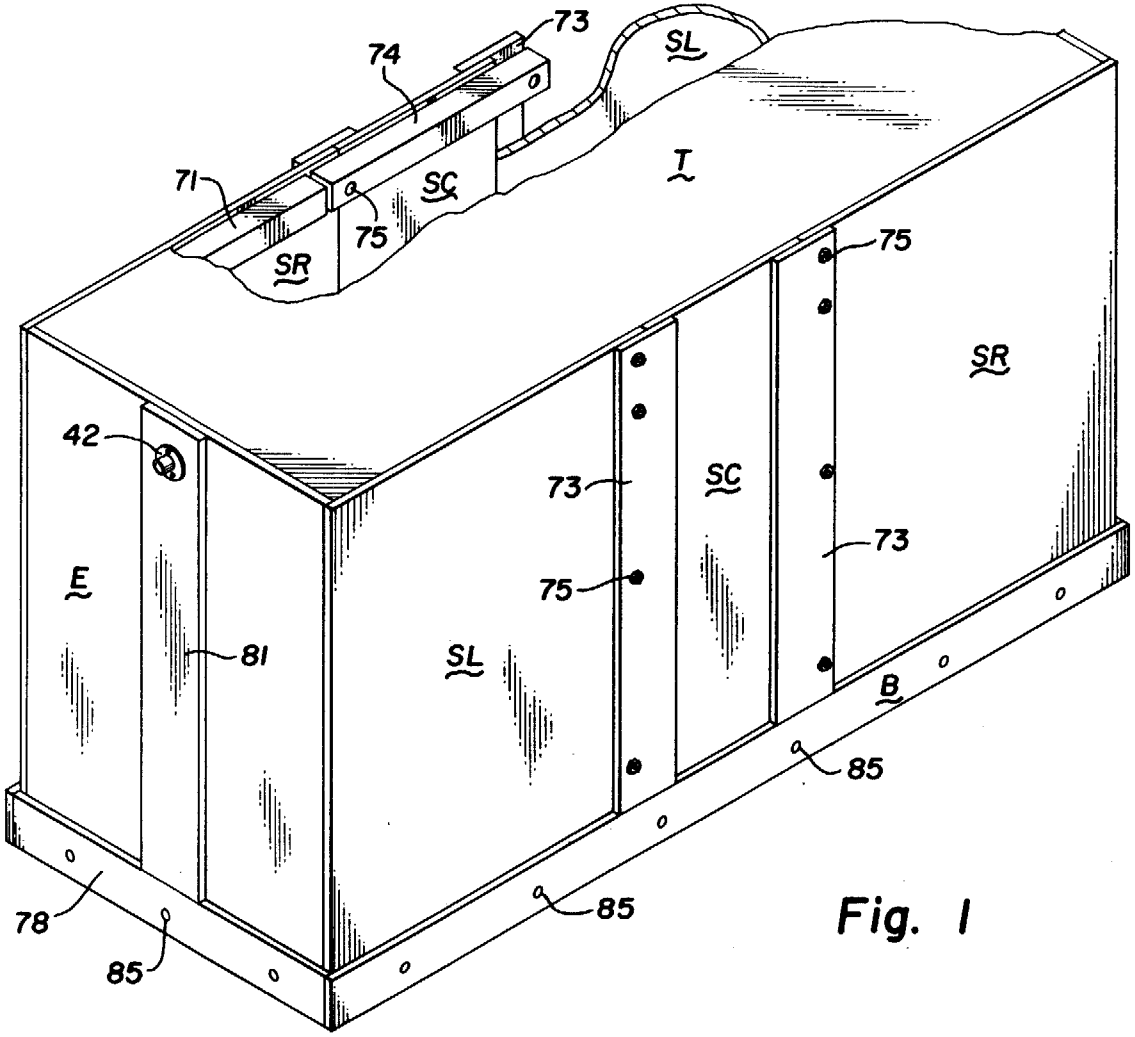
FIG. 1 is a perspective view of an enclosure for mounting within and above a ceiling opening.

The elevator storage system of the invention is designed for use with a building ceiling structure; and is illustrated in the drawings for use with the conventional ceiling structure of a residence for example. As seen particularly in FIGS. 3 and 4, the ceiling structure includes conventional wood ceiling joists 11 and underlying ceiling panels 12 such as drywall panels. A ceiling opening 13, formed in the ceiling structure, is defined by peripheral framing members 14, fabricated from the same size boards as the joists for example. To dress the ceiling opening periphery, suitable molding strips 16 are secured over the ceiling panels and underlie portions of the enclosure structure as will be described.

To provide a closed closet chamber, an enclosure 20 is disposed above and within the ceiling opening 13, and is secured to the framing members 14. This enclosure consisting of rectangular side walls, end walls and top walls, may be preassembled from a suitable kit to provide a tight enclosure sealed from dust and insects for example. A preferred form of enclosure will be described subsequently. If the enclosure is to be used as a storage space for clothing or other woolen articles, it may be desirable to fabricate the side walls and top wall from a material such as red cedar wood flake board to provide moth protection.

Figure 3:
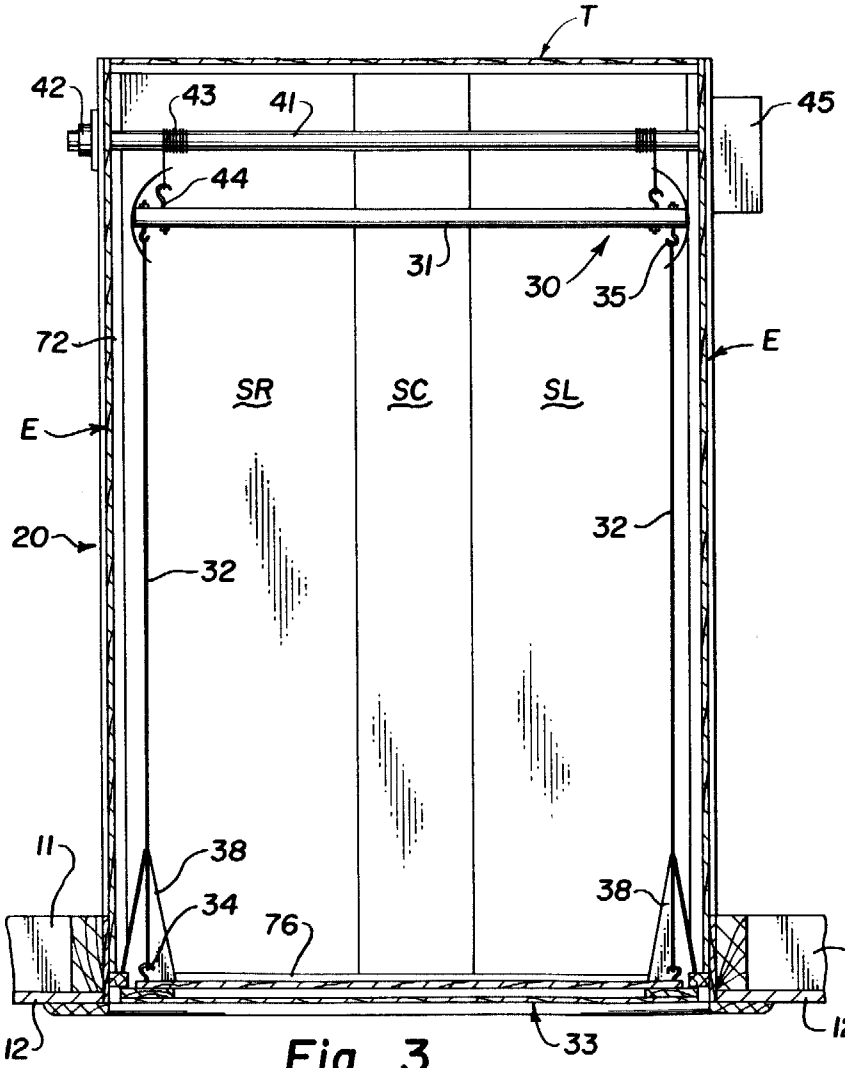
FIG. 3 is a view, partially in section and partially in elevation, of an elevator storage system with an elevator unit in the raised and stored position.
Figure 6:
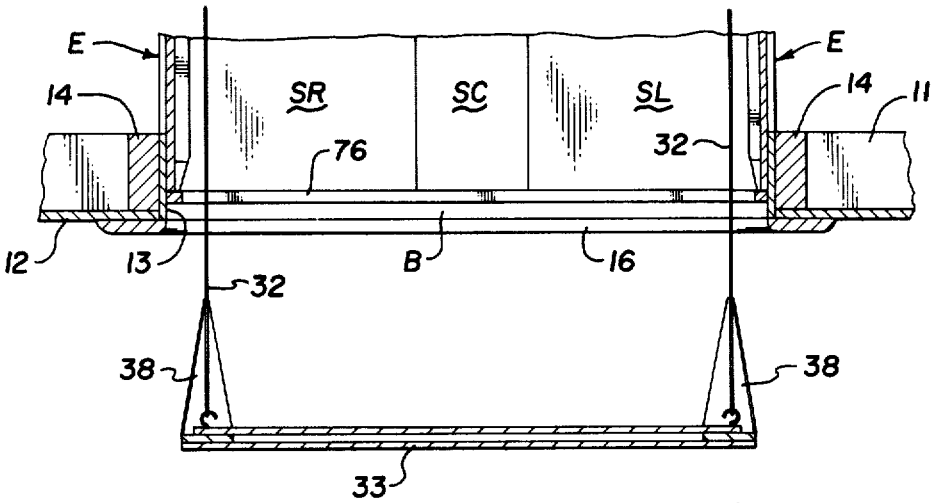
FIG. 6 is a view like FIG. 1, with the elevator unit partially lowered from the stored position.

An elevator unit 30, illustrated in FIGS. 3 and 6, consists of three basic components, namely: a transverse support member in the form of a clothes bar 31, suspension members in the form of cables 32 suspended from the clothes bar, and a horizontal base platform 33 supported by the suspension cables 32, whch functions as the closure for the ceiling opening 13 and also may function as a storage floor or platform. As seen in the drawings, the suspension cables 32 are attached to the base platform by means of hook bolts 34 for example; and the upper ends of the cables are secured to the clothes bar by means of hook bolts 35, the threaded shanks of which extend through transversely aligned holes in the clothes bar. These hook bolts 35 provide means for fine adjustment of the effective suspension cable length between the clothes bar and base panel.

Figure 7:
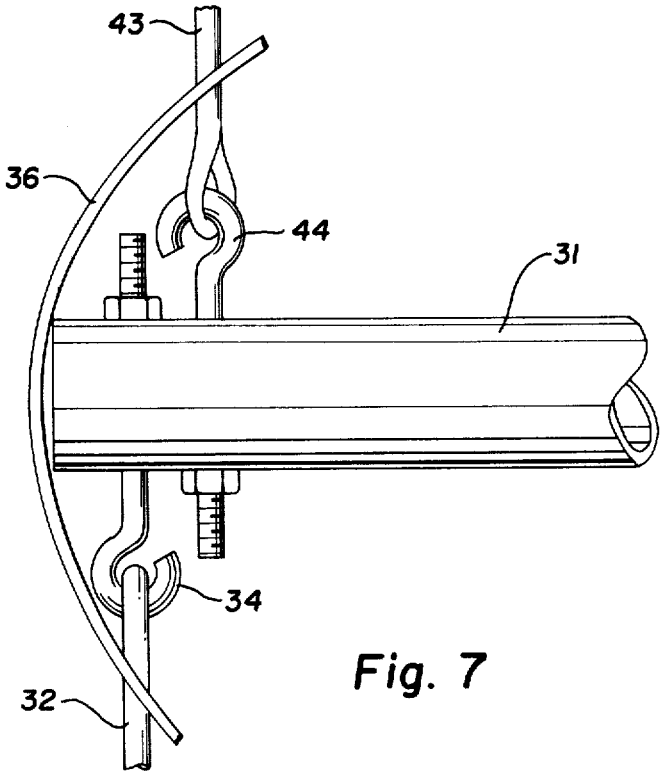
FIG. 7 is a fragmentary detail view of the suspension adjustment mechanism for the system.

If it is desired that the closet system and elevator unit 30 accommodate long articles of clothing such as coats and dresses, the above-described enclosure 20 may be sixty inches wide, 24 inches deep, and 66 inches high. When the elevator unit is lowered for access, the base platform 33 will be lowered to a point approaching floor level; and the clothes bar will be lowered to a point below the ceiling. To prevent marring of the ceiling opening by the support bar 31, during the raising thereof of the elevator end guides 36 are secured over the ends of the bar. These guides may have the form of spring metal straps having slits at each end to be engaged with the suspension cables 32 and lift cables 43 as best seen in FIG. 7.

Figure 4:
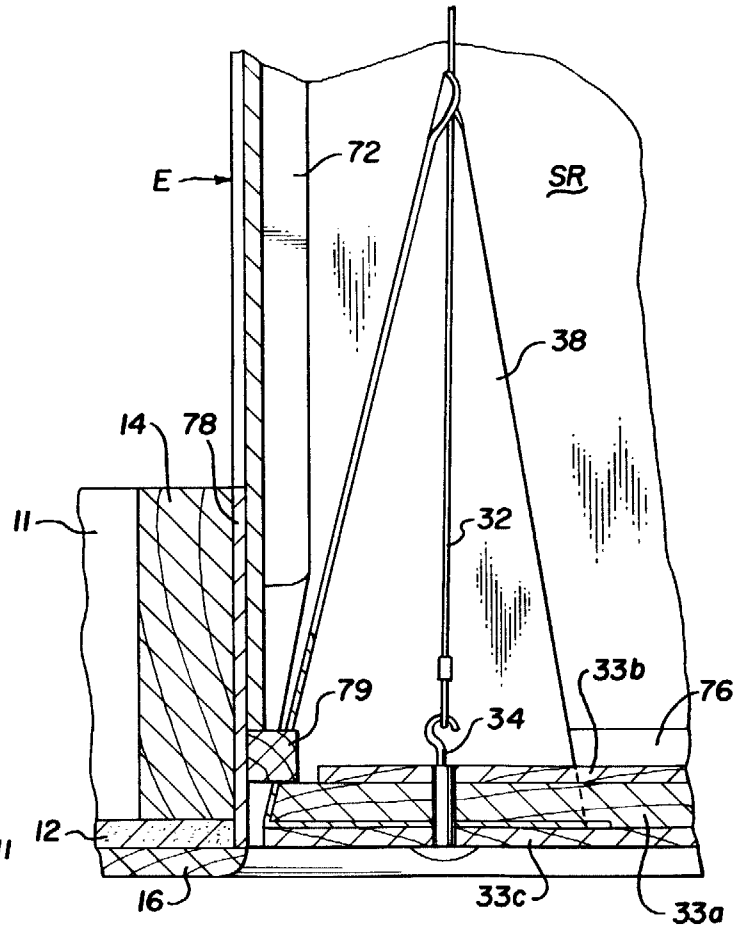
FIG. 4 is a fragmentary sectional detail view of the ceiling opening, and the elevator unit closure.
Figure 5:
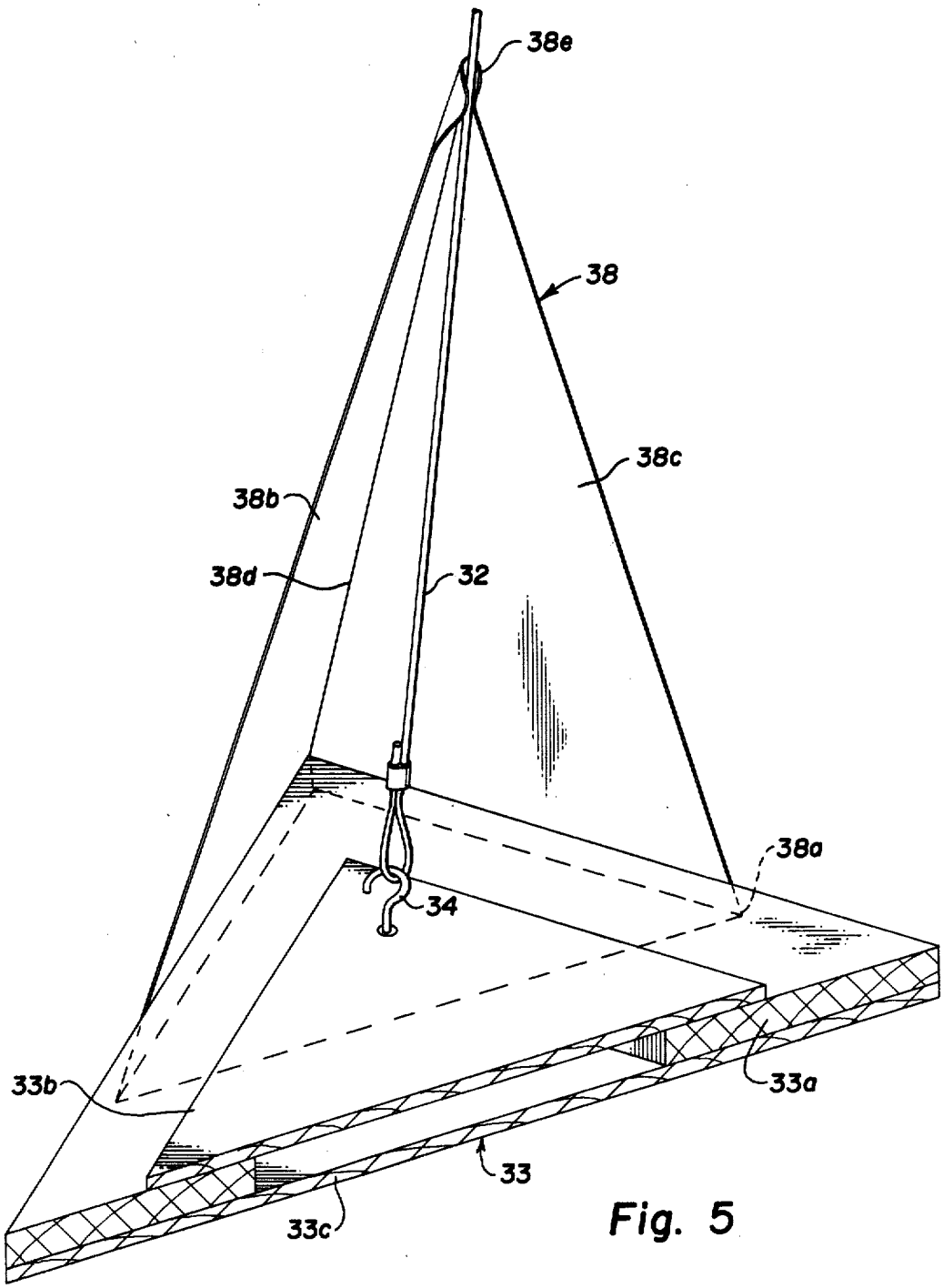
FIG. 5 is a fragmentary detail view of the elevator platform and corner guide.

The base panel 33 preferably has sufficient thickness and rigidity to provide a load bearing floor for stored articles and, as best seen in FIGS. 3, 4 and 5, includes an interior flat frame 33*a*, fabricated from 1×4 lumber for example, an upper floor panel 33*b*, fabricated from quarter inch material such as plywood, Masonite fiberboard, or cedar wood flake board for example, and an underlying finish panel 33*c*, fabricated from quarter inch plywood or Masonite fiberboard for example to provide the ceiling surface of the closure when the elevator unit is in the raised position. In this raised position, the base platform and closure seats within the ceiling opening, as will be described more fully, to provide an aesthetically pleasing ceiling surface. Corner guides 38 are mounted at the four corners of the base platform 33 to coact with certain structure within the ceiling opening, as will be described, to prevent or minimize any marring or disfiguration of the ceiling surface at the periphery of the ceiling opening, when the closure is seating with the ceiling opening.

A preferred form of corner guide 38, as best seen in FIGS. 4 and 5, is fabricated from sheet metal and configured in the form of a partial pyramid having a triangular base wall 38*a* and two side walls 38*b* and 38*c* which are joined at an approximate 90° angle and are somewhat inclined from vertical planes to define an inclined ridge 38*d* at the juncture of the two side walls. The side walls are crimped toward each other adjacent to the apex to define a confining channel 38*e* for a suspension cable 32. In the preferred form illustrated, the base platform 33 is supported by four suspension cable 32, each secured to the base panel adjacent to a corner thereof. The hook bolts 34 are preferably in the form of hook bolt assemblies having a headed, internally threaded shank portion which extends from the bottom of the base platform through a predrilled hole, and an externally threaded hook portion which is received in the shank. The base wall 38*a* of the corner guide 38 is provided with an aperture through which this bolt assembly passes; and the corner guide is assembled with the base platform with the base wall 38*a* disposed between the platform frame 33*a* and ceiling panel 33*c*. The corner guide ridge 38*d* then is inclined upwardly and inwardly from the corner of the base platform, and the apex of the corner guide coacts with the suspension cable 32 by confining the cable within the channel 38*e*. In this manner, should the suspension cable engage a portion of the ceiling opening structure, due to some swaying of the elevator unit for example during the raising, the corner guide will follow smoothly into engagement with that portion of the ceiling opening and guide the closure 33 smoothly to its aligned and seated position within the ceiling opening.

The elevating hoist mechanism includes a shaft 41, defining a winch drum, rotatably supported in suitable bearings 42 in the end walls of the enclosure. Lifting cables 43 wrapped around the winch drum extend downward for attachment to the clothes bar support member 31. Again, as best seen in FIG. 6, the lifting cables 43 are secured to the clothes bar by means of suitable hook bolts 44 to provide for fine adjustment of the lift cable length, and accordingly of the height of the elevator unit 30 relative to the winch shaft. For driving the winch shaft, an electric motor drive unit 45 is mounted on the exterior of one enclosure side wall E and coupled to the winch shaft. This motor unit is controlled through a suitable control circuit including a manual switch for controlling both the lowering and raising of the elevator unit. Preferably, the manual switch would be a key operated switch to prevent operation of the switch by children for example; and also to provide a security storage unit. The system may be used then to secure either articles of some value, or articles which need to be made unaccessible to children, for example. Other desired features of the motor drive unit 45 and associated control circuit would be that the drive unit shut off automatically when the elevator unit reaches the storage position; and for this purpose a push button switch might be mounted in a suitable location to be engaged by the elevator unit base platform in the raised position. Another desirable control feature would be that an automatic reversing control be provided for the drive motor in the event that some object interferes with the complete closure of the elevator unit closure 33. An assocated safety feature would be the provision of a slip clutch in the drive motor unit to prevent damage to the unit in the event of failure of either the reversing mechanism or the stop switch 46, for example.

A preferred form of enclosure 20, particularly illustrated in FIGS. 1, 2, 9 and 10 is made up of prefabricated panels and battens designed to be readily assembled on the installation sight, and to be readily secured to the framing members 14 within the ceiling opening 13. FIG. 1 of the drawing illustrates an enclosure of abbreviated height, relative to its length; but it will be recognized that enclosures of various height and dimension may be provided having the same basic structural design. The several components of the enclosure are best seen in FIG. 1; and these include three panels SL, SC, and SR, and a bottom batten B for each of the side walls, end panels E which define the end walls, and a top panel T. All of the panels described are fabricated from one quarter inch paneling material such as plywood, Masonite or cedar flake board, for example. For a clothes closet enclosure, the panels SL, SR and E may have a width of 24 inches for example while the panels SC have a width of 12 inches providing a cross sectional dimension of approximately 60 inches by 24 inches. For the purposes of the following description, it will be assumed that the panels SL, SC, SR, E and T are fabricated from one quarter inch cedar board and that the several battens to be described are fabricated from one quarter inch plywood.

Referring now to the specific structural details of the several panels, the panel SR includes an upper support rib 71, fabricated from a ¾ inch by ¾ inch wood strip for example, to which the panel is secured by staples, for example. This support rib is mounted ¼ inch from the top of the panel SL; and this support rib, along with counterpart ribs on the other side wall and end wall panels provides a support for the top panel T. The panel SR also includes a vertical joint rib 72 fabricated from similar wood material, mounted adjacent to the left edge of the panel as viewed from the interior. This rib, to which the panel may be secured by staples, is spaced from the left edge of the panel a distance of ¼ inch to allow for the seating of the end panel E as best seen in FIG. 1. The panels SL are similar in construction, with the exception that the joint ribs 72 are disposed adjacent to the right hand edges as viewed from the interior. The panels SC, which may be 12 inches wide for example, are provided with two exterior vertical joint battens 73 which are about 5½ inches wide for example and which extend beyond the edges of the panel SC about 2¾ inches. These panels are also provided with upper support ribs 74, the support ribs having a length coextensive with the lateral span of the panel including the joint battens. In the assembly of the side wall panels, the panels SL and SR abut the panel SC and, at the upper edges, are received within confining slots defined between the joint battens 73 and support ribs 74. The three panels of the side wall are secured together by suitable stove bolts 75 for example with the upper bolts passing through prebored holes in the support rib 74. The assembly of the side walls is completed with the addition of the base batten B. This batten, illustrated in FIG. 10, may have a width of 5½ inches, and has secured thereto a generally coextensive stop 76 fabricated from a ¾ by ¾ inch wood strip for example which is spaced one inch from the lower edge of the batten. In the assembly of the batten B to the side wall, the stop 76 is abutted against the lower edges of the panels SL, SC and SR and secured in place with staples for example. The stop 76 then projects inward from the inner wall surfaces of the side wall, as best seen in FIG. 2.

Figure 8:
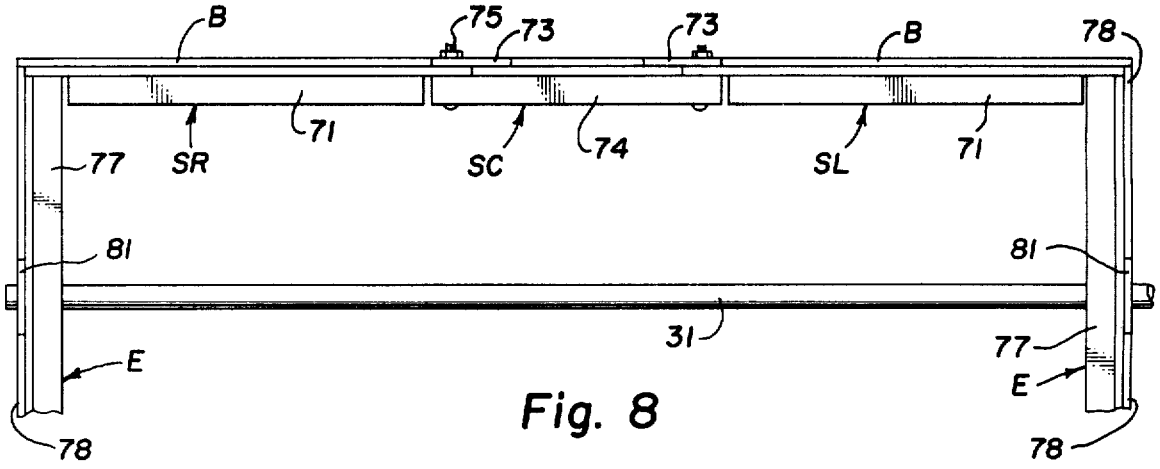
FIG. 8 is a fragmentary top view of the enclosure of FIG. 1, with the top panel removed.
Figure 10:
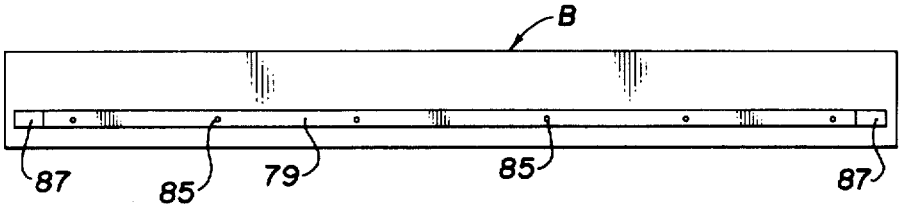
FIG. 10 is a view of a side wall bottom batten for the enclosure of FIG. 1.
Figure 9:
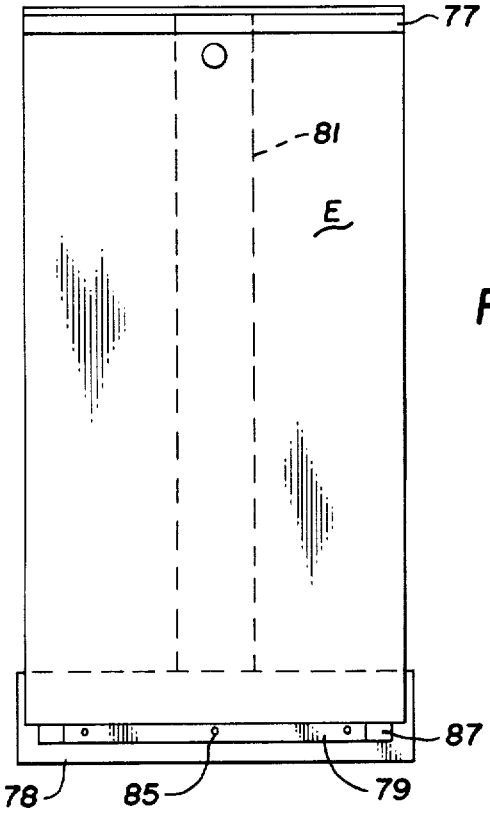
FIG. 9 is an interior elevation view of an end panel for the enclosure of FIG; 1.

The end panels E, best seen in FIGS. 1 and 8, are complete end wall units which include an upper support rib 77, a base batten 78 with inwardly projecting stop 79 abutting the lower edge of the end panel and projecting inward from the inner panel surface. The end panel also includes a vertical strengthening batten 81 consisting of a 5½ inch strip of ¼ inch plywood for example. This strengthening batten is disposed at the center of the end panel E, with its lower end abutting the base batten 78 and its upper end being flush with the upper edge of the panel. Holes are provided through the end panels and strengthening batten, adjacent to the top thereof, to pass the winch shaft 41; and a suitable bearing housing 83 is mounted on the exterior of the panel overlying the hole to rotatably support the winch shaft.

The end walls E are secured to the side walls by stapling to the joint ribs for example; and the top panel T is secured to the several support ribs, also by stapling for example. For securing the enclosure 20 to the framing 14, a plurality of prebored holes 85 are provided in the base battens B and 78, and these holes extend through the associated stops 76 and 79, these holes being predrilled to accommodate nails to be driven into the framing 14. If necessary, suitable shims may be placed between the battens and the framing to assure a rigid mounting of the enclosure within the ceiling structure.

Figure 2:
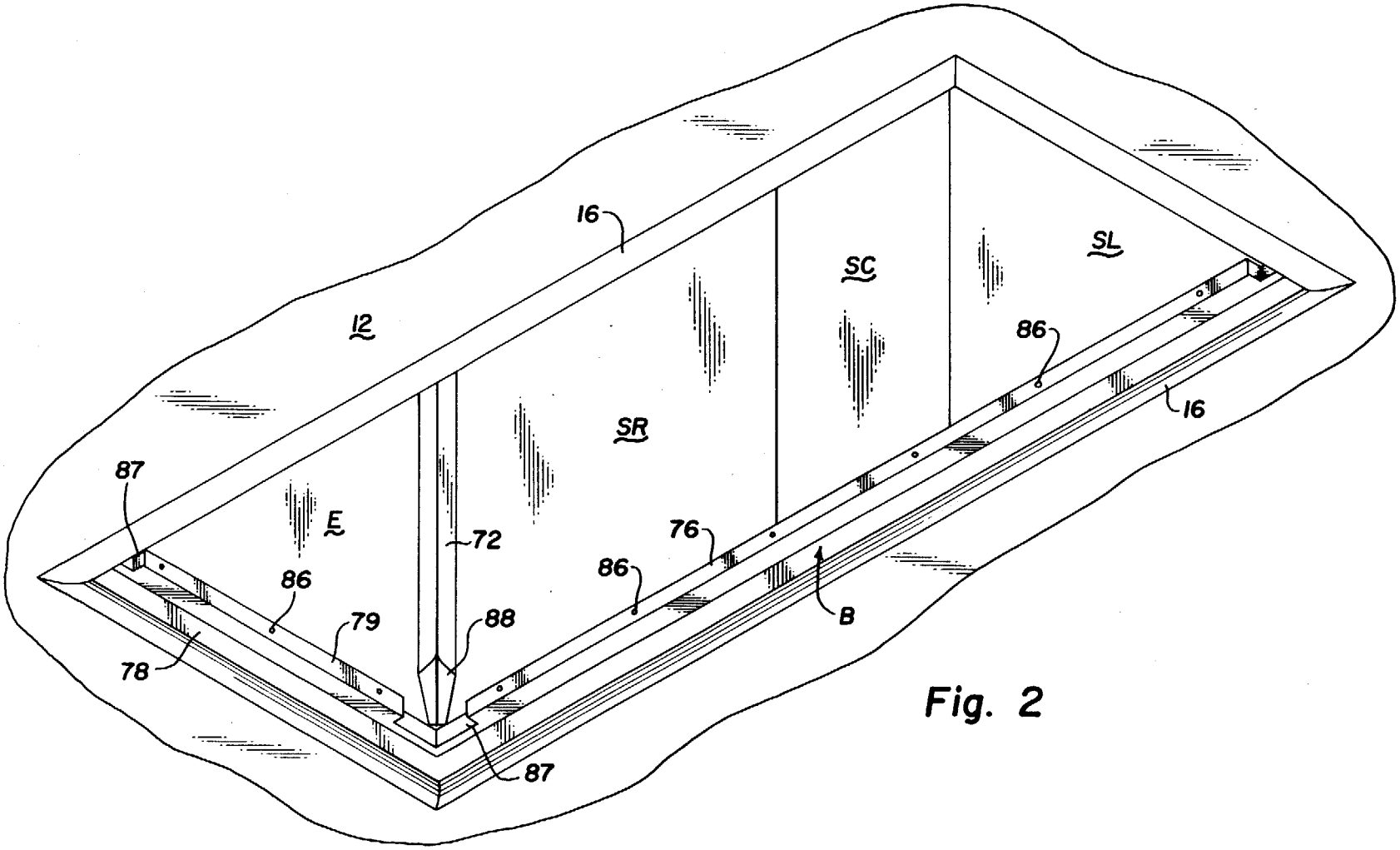
FIG. 2 is a perspective view of a ceiling opening and the associated enclosure of FIG. 1.

FIG. 2 is a perspective view looking upward through a ceiling opening 13 into the enclosure 20 just described. It will be seen in FIG. 2, and also in FIG. 4, that the molding strips 16 cover the lower edges of the base battens B and 78 to provide a finished opening. This view also clearly illustrates the function of the stops 76 and 79, which provide a downward facing shoulder or seat for the base platform-closure 33 of the elevator unit. Also seen in the rib 76 is a push button switch 46 to be engaged by the platform in the closed position. As described, the stops 76 and 79 are recessed from the lower edges of the battens, and correspondingly from the ceiling surface to allow the seating of the platform 33 within the opening flush with the ceiling surface. It will be seen in this figure that the enclosure is secured within the opening by nails 86 or other suitable fasteners. It will also be seen that the stops are provided with end notches or recesses 87; and these are provided to accommodate the corner guides 38, as best seen in FIG. 4. For the same reason, the lower end of the joint ribs 72 are provided with a taper or relief. It will now be seen that when the elevator unit is in the down position, should it be caused to swing sufficiently relative to the ceiling opening, the suspension cables 32 would engage the stops 76 or 79 rather than the molding 16, thereby preventing marring of the paint or other finish on the molding. Similarly, as the elevator unit closure 33 moves toward the closed position, the corner guides will engage the same stops to guide the closure into the perfectly aligned seated position without marring the finish molding 16.

Figure 11:
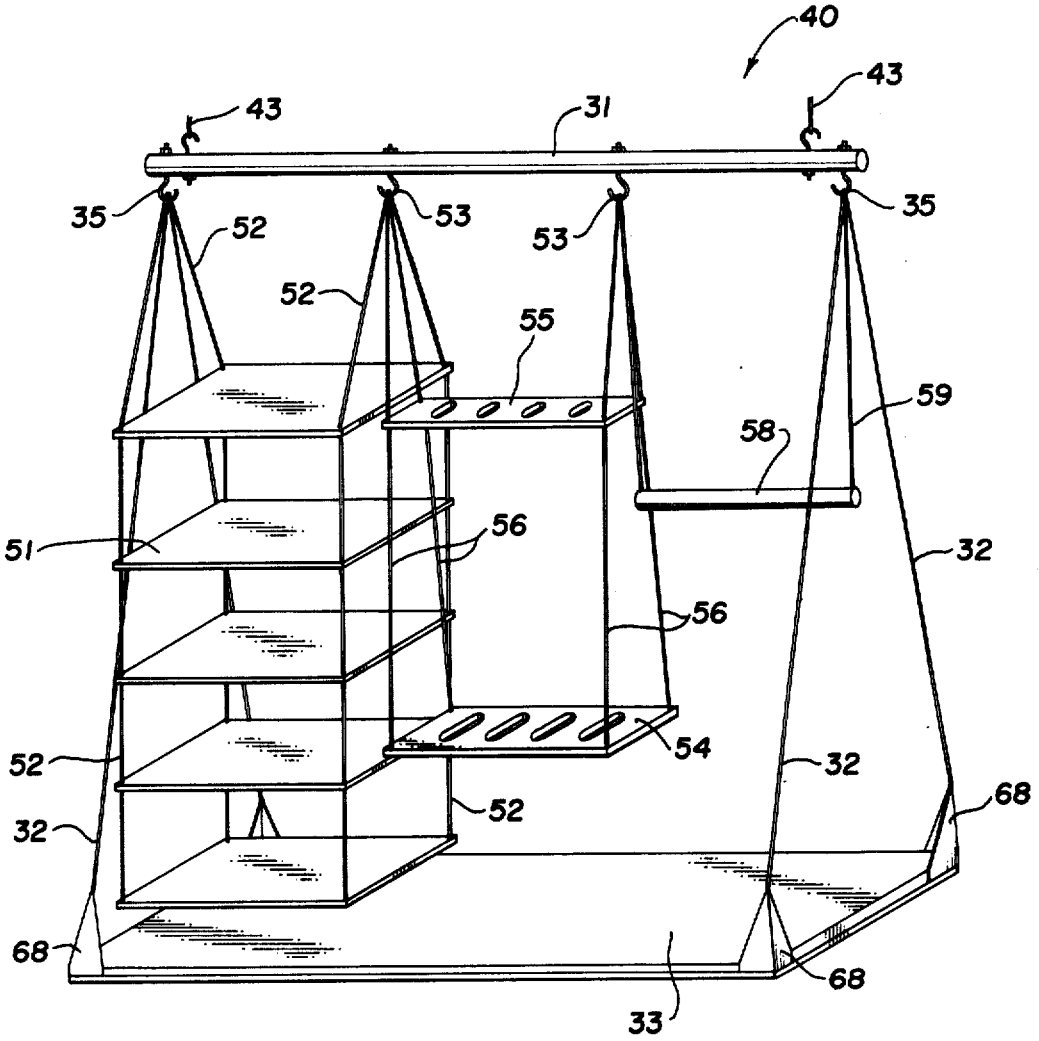
FIG. 11 is a perspective view of a modified form of elevator unit for use in the system of FIG. 3.

FIG. 11 of the drawing illustrates an elevator unit 50 which has the same basic form and components as the elevator unit 30, but which includes other components which might be referred to as accessory components. The accessory components are all suspended from the clothes bar support member 31. It will be seen that two additional hook bolts 53, similar to the bolts 35, are provided on the clothes bar 31 for supporting these accessory components. One accessory component is a shelf unit consisting of five vertically spaced shelves 51 suspended from suitable support cables 52, the support cables being suspended from one of the end hook bolts 35 and an adjacent hook bolt 53.

Another accessory component is a gun rack including a base panel 54 and an upper rack panel 55 supported on suitable cables 56 suspended from the two intermediate hook bolts 53. As illustrated, the base panel 54 is provided with four longitudinally spaced recesses for receiving the butt ends of rifles or shotguns, and the rack panel 55 is provided with corresponding longitudinally spaced openings for receiving and supporting the barrel ends of these firearms.

A third accessory component is a clothes bar 58 supported by suitable cables 59 from respective hook bolts 35 and 53. The clothes bar 58 is suspended approximately half the vertical distance between the base panel 33 and the support clothes bar 31, so that shorter length articles of clothing such as jackets, blouses, shirts and the like may be hung on both the clothes bar 58 and the overlying portion of the support clothes bar 31.

These accessory components are illustrative of various types of components which might be used with the basic elevator unit 30 to provide very versatile and effective use of the closet or storage space provided by the elevator closet system of this invention.

Figure 12:
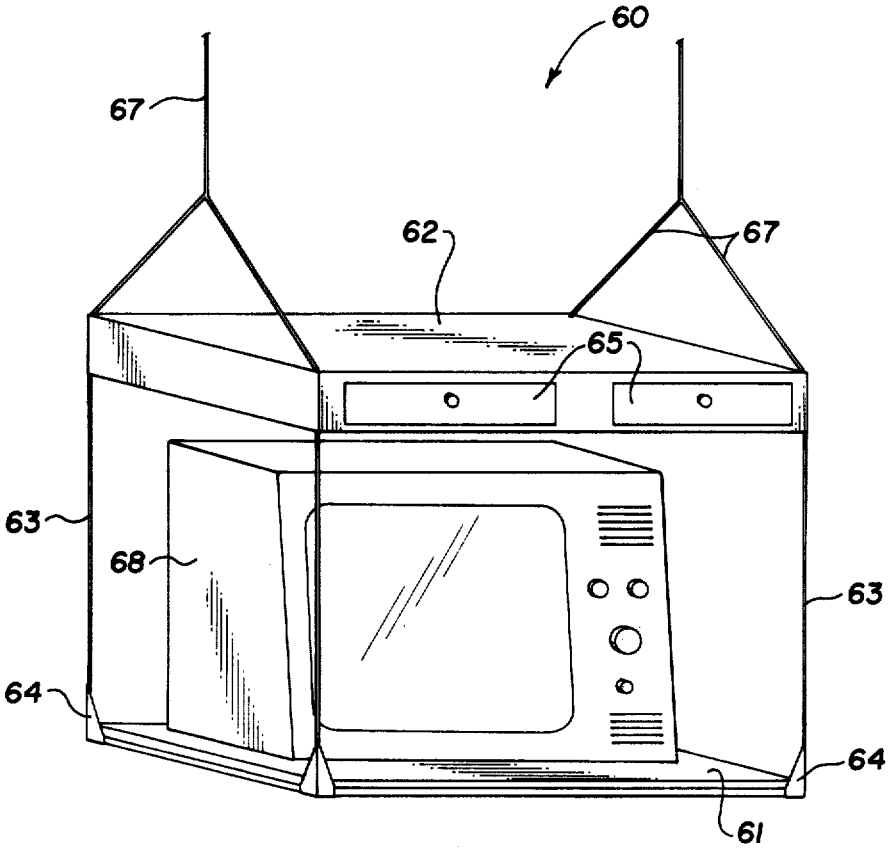
FIG. 12 is a perspective view of another modified form of elevator unit for a system according to the invention.

FIG. 12 of the drawing illustrates another form of elevator unit 60 which might be described as a utility unit. Of course, the closet elevator units 30 may also be described as utility units. As illustrated, the utility unit 60 is particularly adapted for supporting a television set and, for this use, is intended to be dropped from an above ceiling space and suspended, perhaps relatively close to the ceiling, in the use condition. This utility unit includes the same basic components as the other elevator units, namely: a base panel 61, a support member 62 in the form of an upper panel or frame, and cables 63 suspending the base panel from the support member. Cables 67 of the elevator system, similar to that described for the elevator unit 30, raise and lower this unit in the same manner. The base panel 61 is provided with corner guides which function generally for the same purpose as the corner guides 38, particularly in this case to assure the precise lateral seating of the unit 60 within the associated ceiling opening. A suitable enclosure would also be provided above the ceiling opening to protect this unit against dust, etc. in the stored position. As illustrated, the base panel 61 provides a shelf for a TV set 68. Another feature of this unit is that the upper support member 62 carries drawers 65 for the storage of any desired articles, such for example as the secure storage of jewelry or silver dinnerware. For the security aspect, this unit again might be controlled through a keyed lock switch. The circuit installation for this unit would desirably include a remote control for the TV set.

The system of the invention lends itself to other utility unit applications. One such application might be a bar unit for serving drinks and storing liquor. In many households, such a unit is used infrequently; and accordingly such unit is very desirably stored in above-ceiling storage space during non-use times, and lowered to a use position only when desired. An additional advantage of such a unit is that the liquor is conveniently stored during non-use times, through the above described security lock system.

What has been described is a useful and unique elevator closet system or elevator utility unit system having many features and advantages. A principal advantage of the system is that it enables the effective use of space within a building structure which is otherwise not used, and provides conveniences in a residence for example with minimal construction expense. Another advantage of the system is that it provides a security storage system, within the home or other building structure, for storing valuable articles such as clothing, firearms, silver, jewelry, and the like.

While preferred embodiments of the invention have been illustrated and described, it will be understood by those skilled in the art that changes and modifications may be resorted to without departing from the spirit and scope of the invention.

What is claimed is:

1. An elevator storage system, for use in association with a ceiling structure, comprising a storage chamber defined by a ceiling entry opening and overlying above-ceiling space;

an elevator unit, for normal disposition within said storage chamber, comprising an upper transverse support member, a base platform defining a closure for said ceiling opening, and suspension members connected between said support member and said base platform;

an elevating mechanism comprising hoist means disposed in said chamber including at least one lift cable having its lower end connected to said support member, and means for actuating said hoist means to lower and raise said elevator unit;

said base platform having corner guides mounted on peripherally spaced corners thereof; said corner guides extending upwardly from said base platform, and providing upwardly and inwardly inclined, outward facing camming surfaces for engaging confronting inward facing surfaces of said ceiling opening to guide said base platform into said ceiling opening.

2. A storage system as set forth in claim 1 said support member comprising a transverse clothes bar.

3. A storage system as set forth in claim 2 said elevator unit further comprising at least one shelf unit suspended from said clothes bar.

4. A storage system as set forth in claim 1 said storage chamber being defined by an enclosure mounted in said ceiling entry opening; said enclosure comprising generally vertical side walls and a transverse top wall; and said base platform of said elevator unit providing a closure for said enclosure.

5. A storage system as set forth in claim 4 said enclosure being constructed from prefabricated panels formed from sheet material with attached appurtenances.

6. A storage system as set forth in claim 5 said sheet material comprising red cedar wood flake board.

7. A storage system as set forth in claim 5 said enclosure side walls comprising two end walls each formed from a single panel, and two side walls each formed from a plurality of panels; each of said end wall and side wall panels having a transverse support rib adjacent to the top thereof for supporting a top wall panel; certain of said side wall panels having a vertical joint batten for joining to an adjacent side wall panel; and certain of said wall panels having joint ribs adjacent to one edge thereof for supporting an adjacent wall panel.

8. A storage system as set forth in claim 7 said end wall panels having an appurtenant bottom batten overlying and extending below the bottom edge thereof; and a bottom batten amounted on each side wall, coextensive with the panels thereof, overlying and extending below the bottom edges thereof; said bottom battens providing a structural base for the mounting of said enclosure within said ceiling opening.

9. A storage system as set forth in claim 8 said bottom battens having generally coextensive stops spaced from the lower edges thereof and extending inwardly therefrom, said stops defining a seat for said elevator unit base platform.

10. An elevator storage system, for use in association with a ceiling structure, comprising a storage chamber defined by a ceiling entry opening and overlying above-ceiling space;

an elevator unit, for normal disposition within said storage chamber, comprising an upper transverse support member, a base portion defining a closure for said ceiling opening, and suspension members connected between said support member and said base platform;

an elevating mechanism comprising hoist means disposed in said chamber including at least one lift cable having its lower end connected to said support member, and means for actuating said hoist means to lower and raise said elevator unit;

said base platform having corner guides mounted on peripherally spaced corners thereof; said corner guides providing upwardly and inwardly inclined, outward facing camming surfaces for engaging adjacent surfaces of said ceiling opening and guiding said base platform into said ceiling opening;

said base platform being rectangular; said suspension members comprising four suspension cables connected between said support member and the respective four corners of said platform; one of said corner guides being mounted on each of said platform corners; and said corner guides being coupled at their upper ends to respective cables.

11. An elevator storage system, for use in association with a ceiling structure, comprising a storage chamber defined by a ceiling entry opening and overlying above-ceiling space;

an elevator unit, for normal disposition within said storage chamber, comprising an upper transverse support member, a base platform defining a closure for said ceiling opening, and suspension members connected between said support member and said base platform;

an elevating mechanism comprising hoist means disposed in said chamber including at least one lift cable having its lower end connected to said support member, and means for actuating said hoist means to lower and raise said elevator unit;

said base platform having corner guides mounted on peripherally spaced corners thereof; said corner guides providing upwardly and inwardly inclined, outward facing camming surfaces for engaging adjacent surfaces of said ceiling opening and guiding said base platform into said ceiling opening;

each of said corner guides including a pair of triangular side walls joined at one generally vertical edge; said corner guide edge being mounted in alignment with a corner of said base platform, with said side walls being mounted in alignment with platform edges adjacent to said platform corner.

12. A storage system as set forth in claim 11 said corner guide side walls being formed at the apexes thereof to define a channel for confining an associated suspension cable.

13. An elevator storage system, for use in association with a ceiling structure, comprising a storage chamber defined by a ceiling entry opening and overlying above-ceiling space;

an elevator unit, for normal disposition within said storage chamber, comprising an upper transverse support member, a base platform defining a closure for said ceiling opening, and suspension members connected between said support member and said base platform;

an elevating mechanism comprising hoist means disposed in said chamber including at least one lift cable having its lower end connected to said support member, and means for actuating said hoist means to lower and raise said elevator unit;

said base platform having corner guides mounted on peripherally spaced corners thereof; said corner guides providing upwardly and inwardly inclined, outward facing camming surfaces for engaging adjacent surfaces of said ceiling opening and guiding said base platform into said ceiling opening;

bumper guides mounted on the lateral extremities of said support member; said bumper guides extending vertically and inwardly from said extremities, to guide said support member through said ceiling opening.

* * * * *